US009779582B1

(12) United States Patent
Ben Hanan et al.

(10) Patent No.: US 9,779,582 B1
(45) Date of Patent: Oct. 3, 2017

(54) SMART CHIP TRAY ASSEMBLY AND METHOD

(71) Applicants: Igal Shalom Ben Hanan, Ashkelon (IL); Yakov Hananashvili, Ashkelon (IL); David Shato, Ramla (IL)

(72) Inventors: Igal Shalom Ben Hanan, Ashkelon (IL); Yakov Hananashvili, Ashkelon (IL); David Shato, Ramla (IL)

( * ) Notice: Subject to any disclaimer, the term of this patent is extended or adjusted under 35 U.S.C. 154(b) by 0 days.

(21) Appl. No.: 15/492,005

(22) Filed: Apr. 20, 2017

(51) Int. Cl.
*G07F 17/32* (2006.01)

(52) U.S. Cl.
CPC ..... *G07F 17/3248* (2013.01); *G07F 17/322* (2013.01); *G07F 17/3211* (2013.01); *G07F 17/3227* (2013.01)

(58) Field of Classification Search
CPC ..... G07F 17/3248; G07F 17/3211; G07F 17/322; G07F 17/3227
See application file for complete search history.

(56) References Cited

U.S. PATENT DOCUMENTS 4,755,941 A * 7/1988 Bacchi ..... G07D 9/002 273/148 R
5,742,656 A 4/1998 Mikulak
5,757,876 A 5/1998 Dam
8,157,643 B1 * 4/2012 Phan ..... G01G 19/42 273/148 R
8,998,088 B2 4/2015 Koyama
2004/0087375 A1 5/2004 Gelinotte
2007/0184898 A1 * 8/2007 Miller ..... G07D 9/002 463/29
2008/0009339 A1 1/2008 Pat
2011/0070943 A1 3/2011 Ratliff
2012/0105215 A1 5/2012 Gronau
2013/0099444 A1 * 4/2013 Miller ..... A63F 9/00 273/148 A (Continued)

*Primary Examiner* — Corbett B Coburn
(74) *Attorney, Agent, or Firm* — Haim M. Factor; 1st-Tech-Ideas.com

(57) ABSTRACT

A smart chip tray assembly for managing conventional casino chips at a casino table by a dealer and at a casino supervisory location is disclosed. The smart chip tray assembly comprises: a plurality of chip traylets configured to hold the chips; and a pattern of aligned holes and proximity sensors within respective chip traylets. The proximity sensors are configured to sense a presence of individual chips within respective traylets. Additionally, a front panel display in the smart chip tray assembly includes a plurality of traylet displays, with each traylet display corresponding to the respective chip traylet. The front panel display is controlled by a display control button. The chip tray assembly additionally comprises a power source to provide battery and mains power; a communications subsystem to provide wired and/or wireless communication between the smart chip tray assembly and the casino supervisory location; and a CPU which: controls the proximity sensors of each chip traylet; calculates and stores chip traylet chip data; manages the power source, front panel display the communications subsystem. As such, the smart chip tray assembly allows the dealer and supervisory personnel at the table and supervisory personnel in a supervisory location to have up-to-the-moment, real-time information about all of the chips in the smart chip tray.

8 Claims, 5 Drawing Sheets

(56) References Cited

U.S. PATENT DOCUMENTS

Figure 1:
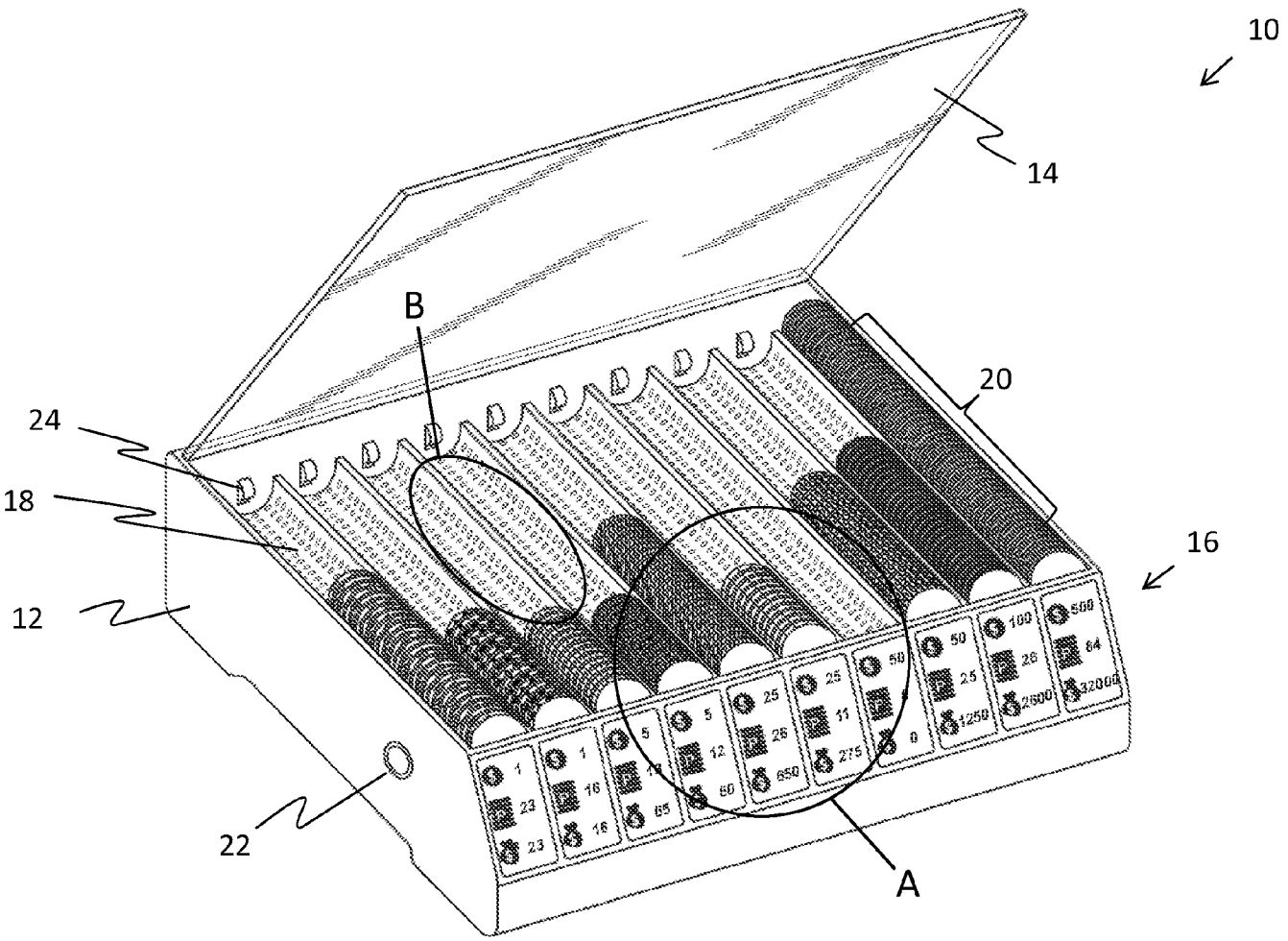

| | | | | |
|---|---|---|---|---|
| 2013/0168449 | A1* | 7/2013 | Lee | G06K 7/10316 235/439 |
| 2014/0339107 | A1 | 11/2014 | Gelinotte | |
| 2015/0279160 | A1* | 10/2015 | Tafty | G07F 17/322 463/25 |

* cited by examiner

Detail A

Detail B

SMART CHIP TRAY ASSEMBLY AND METHOD

FIELD OF THE INVENTION AND BACKGROUND

The current invention relates to chips management in a casino setting, and specifically to smart chip tray assembly and method.

In the specification and claim which follow hereinbelow, the term "chip" is intended to have the same meaning as when used in "casino chip", "gaming chip", or "poker chip", for example. An alternate word, having the same meaning of "chip", is "jeton", which is a token and/or similarly-sized flattened cylindrical object, characterized by a diameter and a thickness, and typically made of plastic or wood and which is used to represent money in a game and/or casino setting.

Currently, in a typical casino setting, there are a relatively large number of so-called "tables" where chips are uses various games, such as, but not limited to: card games; roulette; and other gambling-related games. In virtually all cases, the chips represent a monetary value, and although chips are usually of a uniform size, the monetary value of a given chip is assigned according to a chip's coloring and/or pattern. A "dealer" (ie, person responsible for managing the game—and most importantly, for managing the chips) must keep track of the chips during all phases of the game. A dealer typically uses a "tray" or "drawer", which can be fixed at the table or which is portable, in which the chips are organized as known in the art.

Due to the nature of the games played in casinos and the large number of chips for a given table, each drawer may hold the equivalent of thousands, if not tens or hundreds of thousands of dollars. Casinos have traditionally invested significant efforts to secure and provide safeguards against dealer chip handling errors and/or fraud in the casino. The problem of errors and/or fraud is further compounded by the large number of tables in a given casino.

Traditional solutions have included one or more supervisors circulating throughout the casino floor to oversee tables throughout the casino. Other more hi-tech solutions include closed circuit television cameras, which are designed to view and record the dealer as he handles the chips.

Additionally, when a supervisor or a dealer needs to count chips either during a game and when the table is closed (ie end of the game), such a count typically takes from 5-7 minutes.

Despite the solutions developed, the need to further control errors and prevent chip fraud has spawned other solutions. Prior art which attempt to address the problem are:

US Patent Application Publication no. 2015/0279160, whose disclosure is incorporated herein by reference, in which Tafty describes a computer-implemented method for displaying the total count and value of casino chips stored by a casino dealer during dealing. The method comprises receiving transmissions representative of the reception of casino chips within a groove of a dealer tray, keeping count of the number of chips within the groove at any given time by keeping count of the number of transmissions received, aggregating the values of the individual chips within the groove at any given time and displaying the count and the aggregated value of the chips on a display panel located on the dealer tray.

Thiel et al., in International Patent Application Publication no. WO0167185 2015/279160, whose disclosure is incorporated herein by reference, describes a method and device for tracking the wagering history at a player station of a gaming table (20) includes a chip tray (10) having a plurality of channels (12). A sensor (30) in each channel (12) measures the quantity of chips (14) in the channel (12) and issues a data signal corresponding to the quantity. A processor (40) having a first data structure (50) storing constants for each channel (12) receives the signal from the sensor (30) and calculates an initial total value before the player's wager is resolved and final total value after the player's wager is resolved. The difference between the initial total and final total is stored in a data record in a second data structure (52) corresponding to the selected player position (22). A selector (42) communicating with the processor (40) allows the dealer to select the active player position (22).

US Patent Application Publication no. 2011/0070943, whose disclosure is incorporated herein by reference, in which Ratliff describes a gaining chip/poker chip tray with a laser-type distance measuring device, preferably in the visible range such as a laser diode (but not mandatory), that measures the quantity of gaming poker chips located in each tray. As the device reads the quantity of chips per tray, the information is relayed to a processor which can display the added quantity in real-time. A microprocessor can control the laser reading device, and display. The real-time quantity can be displayed visibly with a digital display device or through a wired or wireless CPU device located on or away from the table containing the Counting Device. This data can be sent individually or in any configuration of networked units and displayed in a multiple of methods such as through a computer data-base, networked custom encrypted software or basic visual display units. In "real-time" means during actual play as chips are placed within the tray or removed from the tray, the Counting Device immediately updates the total quantity located within the tray. The gaming tables using these Poker Chip Tray Counting Devices can be networked together or run separately and independent of each other. If they are networked or linked, a casino or other gaming establishment can know in real-time, how an individual table is doing in terms or winnings or losses, or a selection of tables or the entire network all instantly (based on speed of CPU, wireless-connection, software application or other data-transfer limitations) as play happens.

Gelinotte, in US Patent Application Publication no. 2004/0087375, whose disclosure is incorporated herein by reference, describes a storage device for gaming chips with a memory electronic circuit includes a tray with a plurality of columns adapted to receive stacked chips and equipped with antennas associated with an electronic unit able to communicate in read/write mode with the chips in each column. Each antenna includes a ferrite rod surrounded by a conductive wire coil and having at each end two plane ferrite lugs lying in a plane substantially perpendicular to the rod to form a wide V-shape, the free ends of the lugs being disposed face-to-face in pairs at the two ends of two adjacent columns.

U.S. Pat. No. 8,157,643, whose disclosure is incorporated herein by reference, in which Phan describes a gaming chip counter, for use counting a plurality of gaming chips, each gaming chip have a known predetermined weight. The gaming chip counter has a housing having a top surface, a front, rear, and sides, with digital total displays thereupon. A plurality of counting elements are located on the top surface arranged in counting zones. For each counting zone, a denomination setting system allows the user to establish a currently set denomination. When chips are stacked upon the counting elements in each counting zone, a zone value is determined by weighing the gaming chips thereupon. A total chip value is determined by summation of the zone values, and displayed on the total displays in real time.

Kato Hiroshi, in US Japanese Patent Application Publication no. JP200816526, whose disclosure is incorporated herein by reference, describes a coin storage count indicator, on an inclined flat plate-like body, includes a by-denomination coin storage groove (hereinafter referred to as a groove), an end plate capable of parallel translation downward by a finger in an upright state at the bottom surface in each groove, a measuring means for measuring a position of the end plate, a signal processing means for calculating the number of coins or the amount based on a signal from the measuring means, a digital display device for indicating a signal processing result, and a switch for selecting a display mode to the digital display device, selectively displays any one of the number of the coins, the amount; or the totaling of the sum for all the grooves on the digital display device for a selected groove by pressing down in the groove bottom direction while the end plate is kept in contact with the uppermost end of the coin face in the groove, and can output the display contents data to the outside, if necessary.

U.S. Pat. No. 5,742,656, whose disclosure is incorporated herein by reference, in which Mikulak et al. describe a chip (12) counter (10) which employs an ultrasonic distance measuring system (40) to determine the number of chips in a stack (54, 56) in a chip tray (16) channel (14). A computer (32) initially stores an average chip thickness (T) and receives distance data from the ultrasonic distance measuring system indicative of a first distance (D1) to the bottom of an empty channel. To count chips, the computer repeatedly receives data from the ultrasonic distance measuring system indicative of a second distance (D2) to the top of the stack of chips in the channel. The computer subtracts the second distance from the first distance to determine a height of the stack of chips and then divides the height by the average chip thickness to provide a continuous count of the number of chips in the channel. In a multichannel chip tray, each channel has a distance measuring transducer, and a multiplexer (28) scans all the transducers to provide the computer with second distance data for all channels in the chip tray.

Naim et al, in U.S. Pat. No. 5,757,876, whose disclosure is incorporated herein by reference, describes a system for counting the number of objects of known thickness in a stack and identifying the objects by their color in which an ultrasonic sensor is mounted at a known distance from a reference point that defines the beginning of the stack. The ultrasonic sensor is operated to measure the round trip transit time of ultrasonic energy reflected back from the closest object in the stack and the number of objects in the stack is calculated on the basis of the known distance and the round trip transit time. A color sensor senses the color of at least one object in the stack to identify the object. In a casino application where the objects are chips of known monetary value, the value of the chips in the stack can be calculated.

U.S. Pat. No. 8,998,088, whose disclosure is incorporated herein by reference, in which Koyama describes a chip tray which is capable of accurately reading out an IC tag for use in RFID without increasing a magnitude of a magnetic field generated by an antenna. A magnetic field generating antenna is disposed along a direction in which a plurality of tokens having embedded therein feeder antennas of IC tags for use in RFID are stacked.

Moncek, in Canadian Patent Application publication no. CA2819672, whose disclosure is incorporated herein by reference, describes a device which counts a set of previously designated playing chips by assigning electrically passive characteristics to individual chips and creating electrical networks to measure said characteristics. When the playing chips are individually placed or stacked upon each other, they create an electrical network in which the network's electrically passive characteristics may be measured. By applying voltages, and correspondingly currents, to the aforementioned electrical network, the equivalent characteristics may be mapped to previously designated values associated with a set of individual or stacked playing chips. Correspondingly, a playing chip, a stack of playing chips, or combinations of individual playing chips and stacks with pre-designated values, situated within a well-defined surface area may be counted electronically and automatically summed. The invention may be used to count a set of casino style playing chips in a gaming environment.

US Patent Application publication no. 2012/0105215, whose disclosure is incorporated herein by reference, in which Gronau et al. describe a portable gaming currency reader for reading RFID-enabled gaming currency. By way of example, one portable gaming currency reader has a portable reader housing having a currency reading surface, a shielded antenna located adjacent to the currency reading surface for reading and communicating with the memory of each RFID tag embedded within RFID-enabled gaming currency located on the currency reading surface, and an RFID reader coupled to the shielded antenna for communicating with the shielded antenna to identify, read from and write to each RFID tag associated with RFID-enabled gaming currency located on the currency reading surface. The reader is also provided with a display configured for indicating information about the RFID-enabled gaming currency located on the currency reading surface, such as number and value.

Lee, in US Patent Application publication no. 2013/0168449, whose disclosure is incorporated herein by reference, describes an RFID reader for use in casino chip tray containing: a casino chip tray where RFID tag-embedded casino chips can be accommodated; a housing of which an upper side is opened in order for the casino chip tray to be located; a RFID antenna line which is arranged on the circumference and on the bottom side of the housing; and a RFID reader which is connected to the RFID antenna line.

US Patent Application publication no. 2008/0009339, whose disclosure is incorporated herein by reference, in which Pat et al. describe a gaming table, for use with electronic memory microchip gaming chips, includes a tabletop including a gaming chip storage rack and a test station including a communication unit adapted to exchange information with the memory of a gaming chip in a test area by way of an antenna device, the communication unit being associated with a digital processing unit delivering an output message to the screen of a display device. The layout of the table is such that the screen of the display device is physically separate from the casing of the test station and the test area and the screen are disposed close together on the tabletop, beside the rack and in reach and in view of the operator. The gaming table is usable in casinos and gaming rooms.

Gelinotte et al., in US Patent Application publication no. 2014/0009339, whose disclosure is incorporated herein by reference, describe an RFID plaque box which provides secure storage and protection of value tokens (e.g., gaming plaques and jetons) of all sizes and shapes (e.g., rectangular, square, oval or round) and delivers real-time counting and movement details in both high and low frequency RF environments. The RFID plaque box allows plaques or jetons to be accounted for as part of the table's inventory along with the RFID chip tray's inventory (when installed). The RFID plaque box is provided as a fixed storage area that is situated below the plan of the gaming table alongside the RFID chip tray (when provided) with a lid very similar to that of the RFID chip tray or provided in a pop-up mechanism whereby the RFID plaque box is integrated into a gaming table such that when the top surface of the RFID plaque box is pushed, the RFID plaque box will pop-up to lift the stacks of plaques or jetons for access.

Prior art, however, have shortcomings including, but not limited to:

- RF marking of chips has proven to be cumbersome and can be relatively easily circumvented;
- Traditional closed circuit television has likewise proven to be limited in its effectiveness;
- A chip drawer must remain portable—as a dealer typically moves from a controlled cashier area, setting up his table on the casino floor, and at the conclusion of a shift or game, closes the table, moving to the controlled cashier area. As such, a drawer/tray-based solution must allow for mobility and high reliability; and
- The large number of tables across the casino floor demands a scalable solution.
- Closing a table and/or counting the chips during a game is time-consuming, typically taking from 5-7 minutes each time.

There is therefore a need to provide chip management and to secure/provide safeguards against error/fraud from chip handling in the casino. An ideal solution allows for no change/adaptation of typical casino chips, the chip tray to be portable, while having high reliability and scalability across the casino floor—all while saving time.

SUMMARY OF INVENTION

According to the teachings of the current invention, there is provided smart chip tray assembly for managing conventional casino chips at a casino table by a dealer and at a casino supervisory location, the smart chip tray assembly comprising: a plurality of chip traylets configured to hold the chips; a pattern of aligned holes and proximity sensors, within respective chip traylets, the proximity sensors configured to sense a presence of individual chips within respective traylets; a front panel display including a plurality of traylet displays, each of the plurality of traylet displays corresponding to the respective chip traylet, the front panel display configured to be controlled by a display control button; a power source configured to provide battery and mains power for the smart chip tray assembly; a communications subsystem configured to provide wired and/or wireless communication between the smart chip tray assembly and the casino supervisory location; a CPU configured to: control proximity sensors of each chip traylet; calculate and store chip traylet chip data; manage the power source; manage the front panel display; and manage the communications subsystem, wherein the smart chip tray assembly is configured so that the dealer and supervisory personnel at the table and supervisory personnel in a supervisory location have up-to-the-moment, real-time information about all of the chips in the smart chip tray. Preferably, the individual chips are characterized by a diameter and a thickness and the chips rest radially within the chip traylet and are aligned thickness-to-thickness.

Most preferably, respective chip traylets have a longitudinal axis defined therein and the pattern of aligned holes and sensors is aligned symmetrically with respect to the longitudinal axis. Typically, the pattern of aligned holes and sensors has a pitch with a value of substantially 2 of the chip thickness, the pattern configured so that two alternate proximity sensors sense the presence or absence of the individual chip. Most typically, the front panel display is configured to display at least two modes of information. Preferably, a first mode of information includes the traylet display having three sets of information displayed for each chip traylet, including: a chip value; a number of chips; and a total traylet value. Most preferably, the front panel display is configured to utilize traylet displays to display a total value of chips in the smart chip tray assembly. Typically, the display control button is further configured to control other display modes and to transmit the modes of information displays to a supervisory location. Most typically, the communications subsystem is configured to control transmission. Preferably, the smart chip tray assembly further comprises a structure and a cover, the cover being substantially transparent and configured to be closed on the structure when the smart chip tray is moved, to securely maintain the chips in position therein.

According to the teachings of the current invention, there is further provided a method of assembling a smart chip tray assembly for managing conventional casino chips at a casino table by a dealer and at a casino supervisory location, according to the following steps: configuring a plurality of chip traylets to hold the chips; forming a pattern of aligned holes and aligning proximity sensors within respective chip traylets, the proximity sensors sensing a presence of individual chips within respective chip traylets; including a front panel display controlled by a display control button, the front panel display further including a plurality of traylet displays, each of the plurality of traylet displays corresponding to a respective chip traylet; using a power source to provide battery and mains operation of the smart chip tray assembly; including a communications subsystem to provide wired and/or wireless communication between the smart chip tray assembly and a casino supervisory location; configuring a CPU to: control sensors of each chip traylet; calculate and store chip traylet chip data; manage the power source; manage the front panel display; and manage the communications subsystem, wherein the smart chip tray assembly allows the dealer and supervisory personnel at the table and supervisory personnel in a supervisory location to have up-to-the-moment, real-time information about all of the chips in the smart chip tray.

Preferably, the individual chips are characterized by a diameter and a thickness and the chips rest radially within the chip traylet, and are aligned thickness-to-thickness. Most preferably, respective chip traylets have a longitudinal axis defined therein and the pattern of aligned holes and sensors are aligned symmetrically with respect to the longitudinal axis. Typically, the pattern of aligned holes and sensors has a pitch having a value of substantially of the chip thickness, whereby two alternate proximity sensors of the pattern sense the presence or absence of the individual chip.

LIST OF FIGURES

Figure 2:
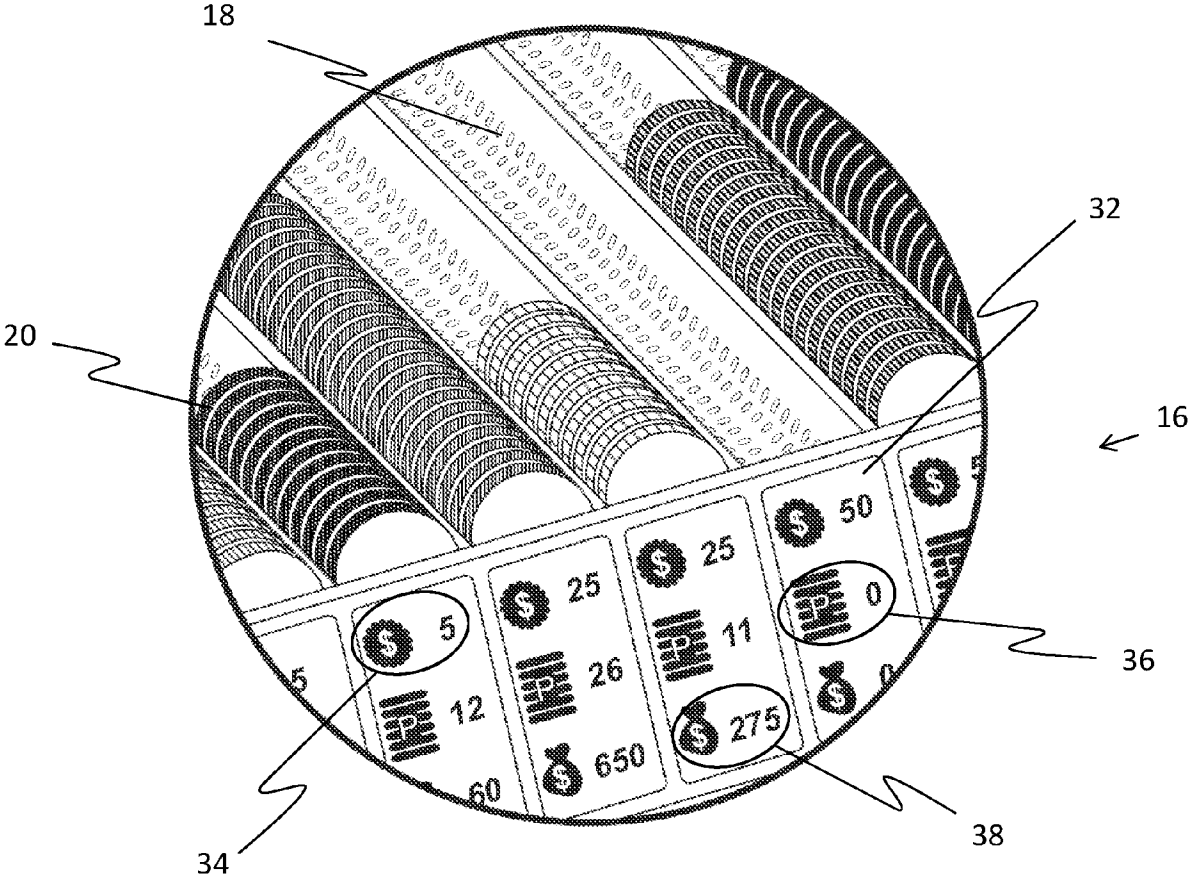
Figure 3:
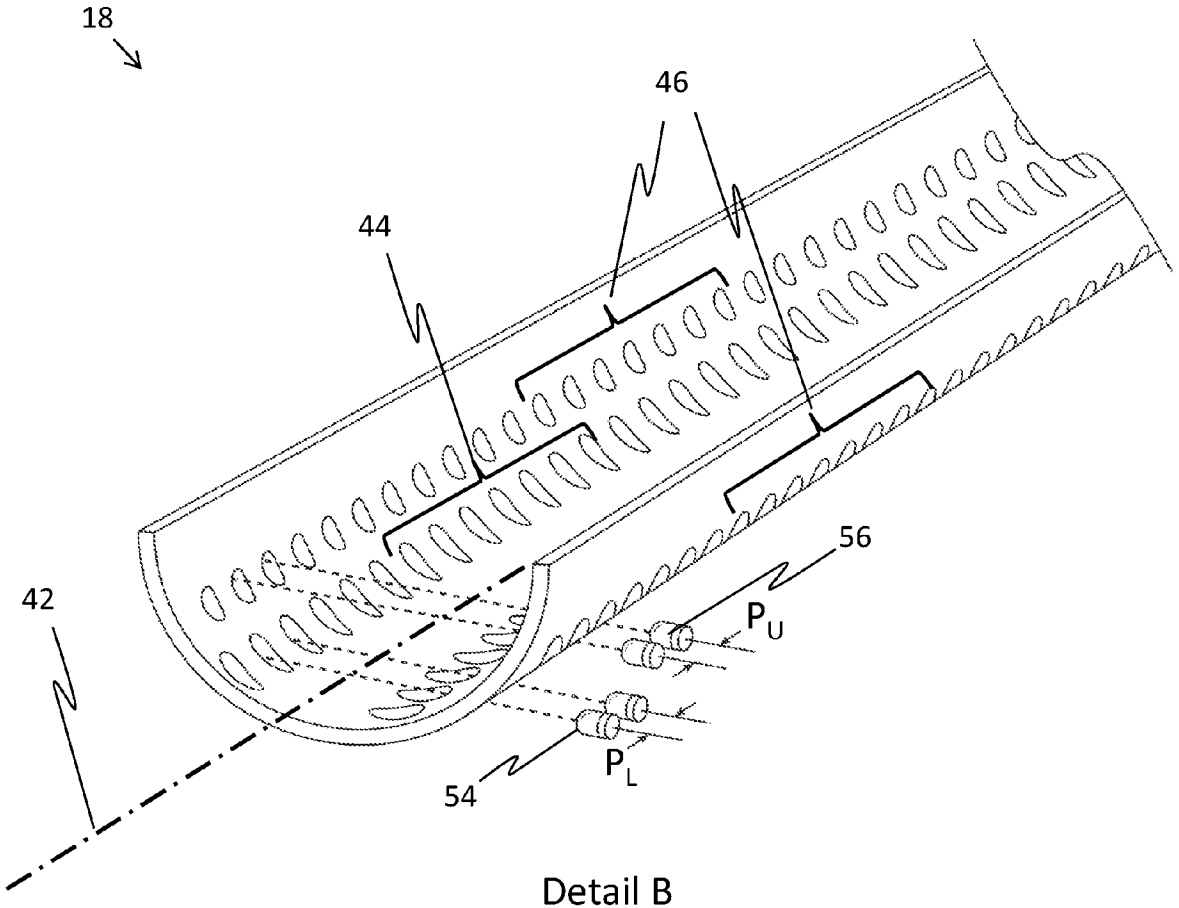
Figure 4:
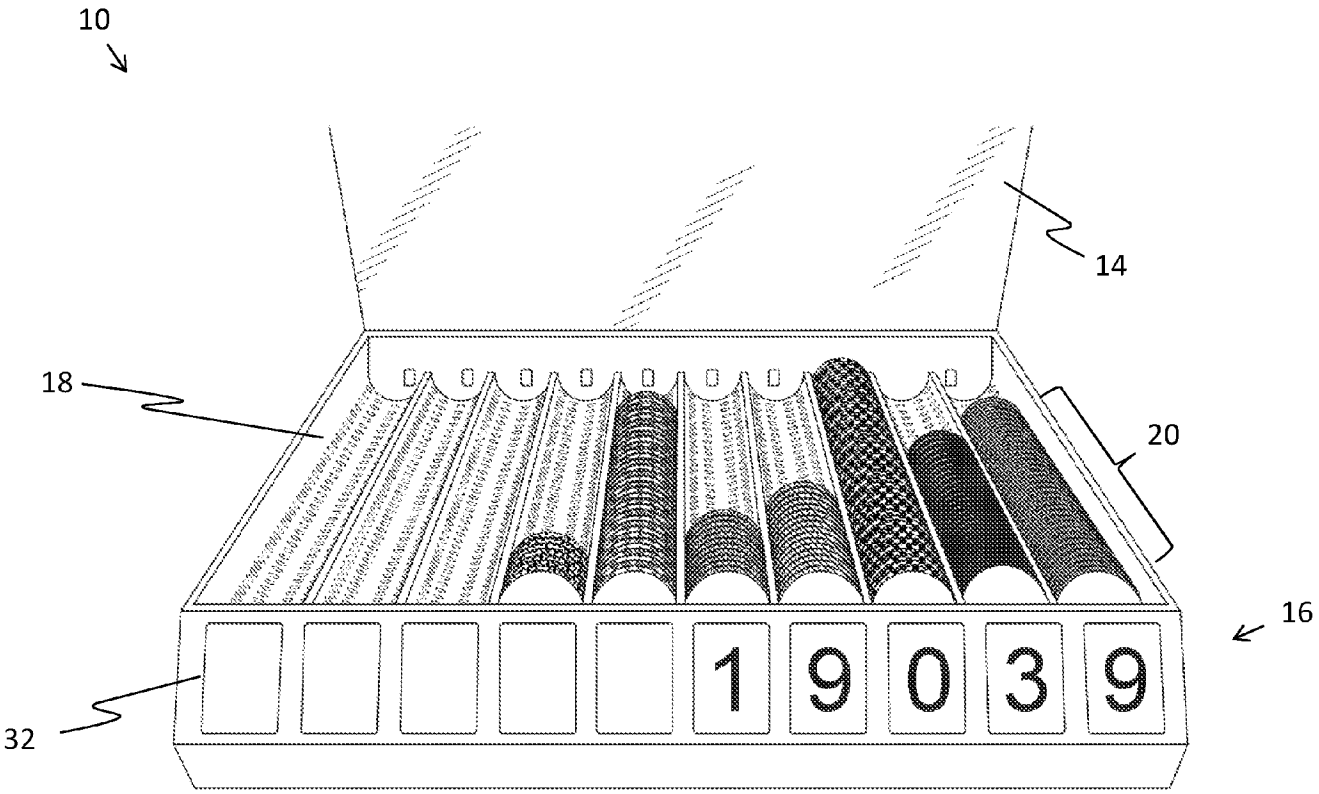
Figure 5:
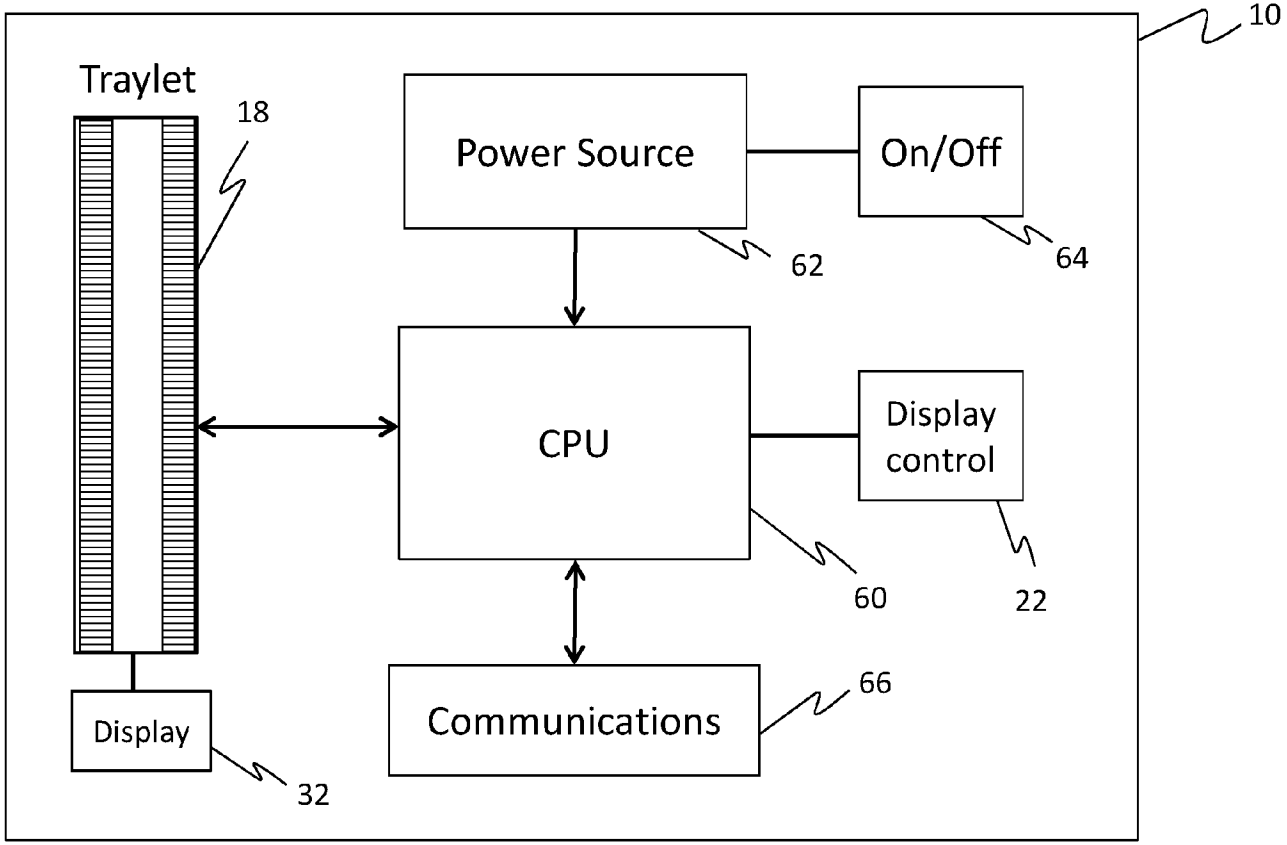

The invention is herein described, by way of example only, with reference to the accompanying drawings, wherein:

FIG. 1 is a pictorial representation of a smart chip tray assembly, in accordance with embodiments of the current invention;

FIG. 2, which is pictorial representation of Detail A of the front panel display, shown in FIG. 1, in accordance with embodiments of the current invention;

FIG. 3, which is pictorial representation of Detail B of the traylet shown in FIGS. 1 and 2, in accordance with embodiments of the current invention;

FIG. 4, which is frontal view of the pictorial representation of the smart chip tray assembly shown in FIG. 1; and FIG. 5 is a block diagram of the smart chip tray assembly, in accordance with embodiments of the current invention.

DETAILED DESCRIPTION

Embodiments of the present invention relate to chip management in a casino setting, and specifically to smart chip tray assembly and method.

Reference is currently made to FIG. 1, which is pictorial representation of a smart chip tray assembly 10, in accordance with embodiments of the current invention. Smart chip tray assembly includes: a tray structure 12; a cover 14; a front panel display 16; a plurality of chip traylets 18, in which a plurality of typical casino chips 20 are placed; a display control button 22; and a mechanical stop 24 for respective dedicated-chip traylets.

In the specification and claims which follow, the word "traylet" is intended to mean an individual tray in which a plurality of chips are maintained, as known in the art. A plurality of traylets, make up the chip tray, as further described hereinbelow. While the exemplary smart chip tray assembly shown in FIG. 1 and discussed hereinbelow has 10 chip traylets, and each traylet holds a maximum of 64 chips, embodiments of the current invention may have more or less than 10 chip traylets therein and each traylet may have more or less than 64 chips therein.

In the specification and claims which follow, the words "chip" and "chips" (as used, for example, in "casino chip") is intended to mean "conventional casino chip(s)", as known in the art, the chips not having any modifications/additions, such as, but not limited to: a RF indication/marking and any chip material alteration.

Tray structure 12 provides a sturdy but lightweight enclosure for the smart chip tray assembly. Cover 14 is hinged (to open as shown in the figure) or is otherwise-moveable to allow chips to be added or removed from the smart chip tray assembly (such as when used at the casino table or at supervisory location, such as at a cashier location). When the smart chip tray assembly is moved (for example, when taken to and from the casino table), the cover is closed on the tray structure to securely maintain the chips in position therein. Optionally or alternatively, the cover may be locked in place (not shown in the figures).

Tray structure 12 is opaque and is fabricated from materials such as, but not limited to: plastic and epoxy resin. Cover 14 is substantially transparent or translucent and is fabricated from materials such as, but not limited to: perspex; acrylic; and polycarbonate.

The display control button controls display of a total value of chips in the tray (discussed hereinbelow in subsequent figures) or display of details regarding the chips in each traylet (as shown in the current figure). Mechanical stop 24 is configured at an end of respective traylets, opposed to the display. The mechanical stop serves to limit the number of chips which may be inserted into a respective traylet.

Chips 20 are placed in respective traylets according to the chips' respective values. Typically, chips having the lowest value (for example, $5 each) are placed together in the rightmost traylet, while chips having respectively higher values are placed together in traylets, moving from left to right. (Such a configuration of chips within the tray is similar to the manner of which chips are typically organized in a conventional tray.) However any order of placement of chips in the tray is possible in embodiments of the current invention. The only limitation is that chips having the same value must be placed together in respective traylets.

Detail A identifies details of front panel display 16, which are discussed hereinbelow, FIG. 2, which follows. Detail B identifies details of traylet 18, which are discussed hereinbelow, FIG. 3.

Reference is currently made to FIG. 2, which is pictorial representation of Detail A of front panel display 16, shown in FIG. 1, in accordance with embodiments of the current invention. Apart from differences described below, display 16 and traylet 18 are identical in notation, configuration, and functionality to that shown in FIG. 1, and elements indicated by the same reference numerals and/or letters are generally identical in configuration, operation, and functionality as described hereinabove. Front panel display 16 includes a traylet display 32, corresponding to the respective traylet. Traylet display 32 shows three sets of information for each traylet, including: a chip value 34 (indicated in the figure by a "$" symbol and a value digit); a number of chips 36 (indicated in the figure by a "P" symbol and a number digit); and a total traylet value 38 (indicated in the figure by a bag graphic and a total digit).

In a given traylet, the total traylet value=the chip value (of the traylet)×the number of chips (in the traylet). The display shown in FIG. 2 has respective traylet displays which correctly reflect the traylet contents. For example, the leftmost traylet display in FIG. 2 shows the chip value of $5; the number of chips as 12; and the total traylet value of $60. ($5×12=$60.) Similarly, the rightmost traylet display shows the chip value of $50; the number of chips as 0 (the traylet is empty); and the total traylet value of $0. ($50×0=$0).

Whereas FIG. 2 shows a plurality of traylet displays 32, a discussion of how the number of chips in each traylet is displayed follows. Additionally, other functions associated with display 16 and traylet displays 32 are discussed further with reference to FIG. 4, which follows hereinbelow.

Reference is currently made to FIG. 3, which is pictorial representation of Detail B of traylet 18 shown in FIGS. 1 and 2, in accordance with embodiments of the current invention. Apart from differences described below, traylet 18 is identical in notation, configuration, and functionality to that shown in FIGS. 1 and 2, and elements indicated by the same reference numerals and/or letters are generally identical in configuration, operation, and functionality as described hereinabove.

As noted hereinabove, a chip is characterized by a diameter and a thickness. Traylet 18 serves to hold casino chips, which rest radially within the traylet and are aligned thickness-to-thickness as shown in FIGS. 1 and 2. As such, the traylet has a semicircular cross section, corresponding substantially to the diameter of the chip, with the traylet configured so that the semicircular cross section is open, as shown in the figure, and ready to hold chips. A longitudinal axis 42 is defined at the base of the semicircular cross section of the traylet.

Traylet 18 includes two sets of lower holes 44 and two sets of upper holes 46. Both the lower holes and upper holes are aligned symmetrically with respect to longitudinal axis 42, along the length of the traylet. Furthermore, the lower and upper holes are aligned alternately along the length of the traylet, as shown in the figure.

Embodiments of the current invention incorporate proximity sensors, as known in the art, to sense the presence/absence of individual chips in the traylet, as further described below. The proximity sensors incorporated in embodiments of the current invention utilize sensing of wavelengths including, but not limited to: optical; infra-red (IR); and UV.

Lower proximity sensors 54 and upper proximity sensors 56 are configured outside of the traylet, as shown in the figure, and the sensors are aligned with respect to longitudinal axis 42, along the length of the traylet, so that respective sensors "view" through respective holes. In other words, lower proximity sensors 54 are aimed through lower holes 44 and upper proximity sensors 56 are aimed through lower holes 46, respectively. In FIG. 3, the dotted lines from the sensors through the holes exemplify how the sensors are aligned and aimed.

Although only two sets of upper and lower proximity sensors are shown in the figure for purposes of clarity, it is to be understood that the number of sensors is equal to the number of holes. Additionally, the lower and upper sensors are aligned alternately along the length of the traylet—corresponding to the configuration of the lower and upper holes, as described hereinabove. Lower sensors 54 are configured having a pitch $P_L$ between adjacent lower sensors and upper sensors 56 are configured having a pitch $P_U$ between adjacent upper sensors. Upper and lower holes have equal, corresponding, respective pitches between adjacent holes.

By setting $P_L=P_U$ and by setting $P_L$=substantially to one-half the thickness of a chip, two alternate proximity sensors (ie, one upper sensor and one lower sensor) effectively sense the presence or absence of an individual chip. The use of two sensors to sense a single chip further enhances reliability of the smart chip tray assembly.

Reference is currently made to FIG. 4, which is frontal view of the pictorial representation of the smart chip tray assembly shown in FIG. 1. Apart from differences described below, smart chip tray assembly 10 is identical in notation, configuration, and functionality to that shown in FIGS. 1 and 2, and elements indicated by the same reference numerals and/or letters are generally identical in configuration, operation, and functionality as described hereinabove.

As noted previously, display 16 is composed of a plurality of traylet displays 32. In the current figure, display 16 has individual, large digits in some of the traylet displays—namely 19039, corresponding to $19,039. Embodiments of the current invention include at least two modes of information display on display 16, namely:

- details of the contents of chips in each traylet—as described hereinabove (refer to discussion of FIG. 2)
- a total value of chips in the tray—meaning a summation of the plurality of total traylet values 38 (refer to FIG. 2)

Pushing display control button 22 controls display of the two modes of display, as noted below. In this way, at the table the dealer or a supervisor may immediately see a live tally of the contents of the smart tray—either in a detailed traylet-by-traylet view or in a total-value-of-the-tray view. In other words, the traditional and lengthy time (typically 5-7 minutes) to count chips is virtually eliminated.

In addition to changing the modes of information display, pushing display control button 22 can control other display modes and/or transmission of the display modes to a cashier/supervisory location through wired or wireless means, as described hereinbelow. Optionally or alternatively, the details or the total value information may be remotely queried by supervisory personnel in a supervisory location whenever desired, as further described below.

As such, the dealer at the table, and supervisory personnel-whether at the table or in a supervisory location—have up-to-the-moment, real-time information about all of the chips in the smart chip tray.

Reference is currently made to FIG. 5, which is a block diagram of smart chip tray assembly 10, in accordance with embodiments of the current invention. Apart from differences described below, smart chip tray assembly 10 is identical in notation, configuration, and functionality to that shown in FIGS. 1, 2, and 4, and elements indicated by the same reference numerals and/or letters are generally identical in configuration, operation, and functionality as described hereinabove. In addition to display 16 and traylet display 32 (representing, in both cases, a plurality of traylets and corresponding displays) and display control button 22—all previously described—smart chip tray assembly 10 additionally includes: a microprocessor (CPU) 60; a power source 62, an on/off button 64; and a communications subsystem 66.

CPU 60 coordinates all functionality and housekeeping of the smart-chip tray, including: sensor control of each traylet; traylet chip data calculation and storage (including traylet chip totals, as described hereinabove—ref FIGS. 2 and 4); power management; display control; and communications. CPU 60 includes all hardware and software to provide the functionality noted above, as known in the art.

Power source 62 includes two modes of operation: rechargeable and/or replaceable batteries (not shown in the figures) and mains operation. Necessary mains cords and/or power sockets, as known in the art, are not shown in the figures. Typically, the rechargeable and/or replaceable batteries enable the smart chip tray to be brought to the casino table, the batteries having a sufficient charge for at least 12 or more hours of operation. In this way, the smart chip tray may be operated in a totally autonomous fashion for a typical work shift. However, the smart chip tray may optionally be connected to mains power, if available, at the casino table. Alternatively or optionally, the batteries serve to provide back-up power in case of a mains power outage.

The communications subsystem serves to provide wired and/or wireless communication between the smart chip tray and a casino supervisory location-either within the casino or remotely located. Such communication includes, but is not limited to: receipt of command queries from the supervisory location; (command) receipt of smart chip tray input information including definition of chip values in each traylet; telemetry of smart chip tray chip content information (as described hereinabove, ref FIG. 4); telemetry of smart chip tray input information. The communications subsystem includes all software and hardware to provide communication functionality.

It will be appreciated that the above descriptions are intended only to serve as examples, and that many other embodiments are possible within the scope of the present invention as defined in the appended claims.

The invention claimed is:

1. A smart chip tray assembly for managing conventional casino chips at a casino table by a dealer and at a casino supervisory location, the smart chip tray assembly comprising:

- a plurality of chip traylets configured to hold the chips, the individual chips characterized by a diameter and a thickness and the chips resting radially within the chip traylet and aligned thickness-to-thickness;
- a pattern of aligned holes and proximity sensors, within respective chip traylets, the proximity sensors configured to sense a presence of individual chips within respective traylets and respective chip traylets having a longitudinal axis defined therein, the pattern of aligned holes and sensors is aligned symmetrically with respect to the longitudinal axis and the pattern of aligned holes and sensors having a pitch with a value of substantially ½ of the chip thickness, the pattern configured so that two alternate proximity sensors sense the presence or absence of the individual chip;

a front panel display including a plurality of traylet displays, each of the plurality of traylet displays corresponding to the respective chip traylet, the front panel display configured to be controlled by a display control button;

a power source configured to provide battery and mains power for the smart chip tray assembly;

a communications subsystem configured to provide wired and/or wireless communication between the smart chip tray assembly and the casino supervisory location;

a CPU configured to:

control proximity sensors of each chip traylet;

calculate and store chip traylet chip data;

manage the power source;

manage the front panel display; and manage the communications subsystem, wherein the smart chip tray assembly is configured so that the dealer and supervisory personnel at the table and supervisory personnel in a supervisory location have up-to-the-moment, real-time information about all of the chips in the smart chip tray.

2. The smart chip tray assembly of claim 1, wherein the front panel display is configured to display at least two modes of information.

3. The smart chip tray assembly of claim 2, wherein a first mode of information includes the traylet display having three sets of information displayed for each chip traylet, including: a chip value; a number of chips; and a total traylet value.

4. The smart chip tray assembly of claim 2, wherein the front panel display is configured to utilize traylet displays to display a total value of chips in the smart chip tray assembly.

5. The smart chip tray assembly of claim 1, wherein the display control button is further configured to control other display modes and to transmit the modes of information displays to a supervisory location.

6. The smart chip tray assembly of claim 5, wherein the communications subsystem is configured to control transmission.

7. The smart chip tray assembly of claim 1, wherein the smart chip tray assembly further comprises a structure and a cover, the cover being substantially transparent and configured to be closed on the structure when the smart chip tray is moved, to securely maintain the chips in position therein.

8. A method of assembling a smart chip tray assembly for managing conventional casino chips at a casino table by a dealer and at a casino supervisory location, according to the following steps:

configuring a plurality of chip traylets to hold the chips, the individual chips characterized by a diameter and a thickness and the chips resting radially within the chip traylet and aligned thickness-to-thickness;

forming a pattern of aligned holes and aligning proximity sensors within respective chip traylets, the proximity sensors sensing a presence of individual chips within respective chip traylets and respective chip traylets having a longitudinal axis defined therein, the pattern of aligned holes and sensors is aligned symmetrically with respect to the longitudinal axis and the pattern of aligned holes and sensors having a pitch with a value of substantially ½ of the chip thickness, the pattern configured so that two alternate proximity sensors sense the presence or absence of the individual chip;

including a front panel display controlled by a display control button, the front panel display further including a plurality of traylet displays, each of the plurality of traylet displays corresponding to a respective chip traylet;

using a power source to provide battery and mains operation of the smart chip tray assembly;

including a communications subsystem to provide wired and/or wireless communication between the smart chip tray assembly and a casino supervisory location;

configuring a CPU to:

control sensors of each chip traylet;

calculate and store chip traylet chip data;

manage the power source;

manage the front panel display; and manage the communications subsystem, wherein the smart chip tray assembly allows the dealer and supervisory personnel at the table and supervisory personnel in a supervisory location to have up-to-the-moment, real-time information about all of the chips in the smart chip tray.

* * * * *